US006300963B1

(12) United States Patent
Urbanus et al.

(10) Patent No.: US 6,300,963 B1
(45) Date of Patent: Oct. 9, 2001

(54) SINGLE-FRAME DISPLAY MEMORY FOR SPATIAL LIGHT MODULATOR

(75) Inventors: Paul M. Urbanus, Dallas; Donald B. Doherty, Irving, both of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 08/342,671

(22) Filed: Nov. 21, 1994

Related U.S. Application Data

(63) Continuation of application No. 08/160,554, filed on Nov. 30, 1993, now abandoned.

(51) Int. Cl.[7] ..... G09G 5/36
(52) U.S. Cl. ..... 345/547; 345/574
(58) Field of Search ..... 345/85, 131, 109, 345/108, 187, 189, 192, 193, 190, 200, 203, 545, 547, 574; 348/716, 441, 771, 744, 770; 340/189

(56) References Cited

U.S. PATENT DOCUMENTS

| | | | | |
|---|---|---|---|---|
| 4,789,854 | * | 12/1988 | Ishii | 345/203 |
| 4,818,932 | * | 4/1989 | Odenheimer | 345/190 |
| 4,847,809 | * | 7/1989 | Suzuki | 345/190 |
| 4,868,556 | * | 9/1989 | Murakami et al. | 345/200 |
| 4,910,670 | * | 3/1990 | Smith et al. | 345/200 |
| 5,179,372 | * | 1/1993 | West et al. | 345/189 |
| 5,254,984 | * | 10/1993 | Wakeland | 345/189 |
| 5,255,100 | * | 10/1993 | Urbanus | 358/231 |
| 5,307,056 | * | 4/1994 | Urbanus | 345/189 |
| 5,339,116 | * | 8/1994 | Urbanus et al. | 345/203 |
| 5,371,519 | * | 12/1994 | Fisher | 345/200 |
| 5,438,376 | * | 8/1995 | Watanabe | 345/200 |

FOREIGN PATENT DOCUMENTS

| | | | | |
|---|---|---|---|---|
| 0 530 760 A2 | | 3/1993 | (EP) . | |
| 1262586 | * | 10/1989 | (JP) | 345/200 |
| 4326393 | * | 11/1992 | (JP) | 345/200 |

* cited by examiner

*Primary Examiner*—Amare Mengistu
(74) *Attorney, Agent, or Firm*—Charles A. Brill; Wade James Brady III; Frederick J. Telecky, Jr.

(57) ABSTRACT

A display memory (15) for a display system (10, 20) having a spatial light modulator (SLM) (16). The memory (15) receives data in pixel format and delivers the data to the SLM (16) in bit-plane format. The memory (15) avoids the need for double buffering by reading out bit-planes that are comprised partly of data from one data from and partly of data from an adjacent data frame.

11 Claims, 3 Drawing Sheets

SINGLE-FRAME DISPLAY MEMORY FOR SPATIAL LIGHT MODULATOR

This application is a Continuation of application Ser. No. 08/160,554 filed Nov. 30, 1993, which is now abandoned.

TECHNICAL FIELD OF THE INVENTION

This invention relates to image display systems, and more particularly to systems that process digital image data and use a spatial light modulator to display real-time images.

BACKGROUND OF THE INVENTION

Real-time display systems based on spatial light modulators (SLMs) are increasingly being used as an alternative to display systems using cathode ray tubes (CRTs). SIM systems provide high resolution displays without the bulk and power consumption of a CRT system.

Digital micromirror devices (DMDs) are a type of SLM, and may be used in projection display applications. A DMD has an array of micro-mechanical pixel elements, each having a mirror and a memory cell. Each pixel element is individually addressable by electronic data. Depending on the state of its addressing signal, each mirror element is tilted so that it either does or does not reflect light to the image plane. Other SIMs operate on similar principles, with pixel elements that emit or reflect light simultaneously with other pixel elements, such that a complete image frame is generated by addressing pixel elements rather than by scanning them.

For processing data in an SIM-based systems, as is the case with other digital image processing systems, the processor operates on pixel data. Interlaced data is arranged pixel-by-pixel, row-by-row, and field-by-field. Scan conversion techniques are used to generate frames from fields. In a standard television system, for example, images are transmitted at 30 frames per second, and each frame lasts for approximately 33.3 milliseconds. Non-interlaced data is already arranged as frames.

Processing tasks such as colorspace conversion and scaling, as well as scan conversion, are performed on the pixel data.

However, in an SLM-based system, the SLM must receive the data in "bit-planes". In other words, pixel data must be reformatted into bit-level data so that each pixel element can be "on" or "off" a length of time corresponding to the value of its pixel data. Various modulation schemes determine how long each pixel is on or off, and permit greyscale and color images to be displayed. A bit-plane represents all bits of all pixels having the same digital weight. For pixels having an n-bit resolution, there are n bit-planes per display frame.

SLM-based systems use a "display memory" to provide bit-planes of data to the SLM. Existing display memories are "double buffered", so that they can store data for a current frame while data for a next frame is being written in. This permits each frame of data to be read out of memory and displayed on the SIM during its own frame period. Many display memories operating in this double-buffered mode require a capacity of two frames of data. A variation of double-buffering is dynamically allocating memory space so as to reduce the required capacity. U.S. Pat. Ser. No. 07/755.883, entitled "Dynamic Memory Allocation For Frame Buffer for Spatial Light Modulator", assigned to Texas Instruments Incorporated, discusses these methods of using a display memory.

SUMMARY OF THE INVENTION

A first aspect of the invention is a display memory for use in a digital display system having a processor for performing image processing and having a spatial light modulator (SIM) with bit-addressable pixel elements for generating an image. A first frame of samples of pixel data is written to the memory during a first frame period. This first frame is stored in the memory such that it may be read out in bit-planes comprised of one bit per sample. A second frame comprised of samples of pixel data is written to the memory during a second frame period, such that each sample of the second frame is written over the corresponding sample of the first frame. This second frame is also stored so that it may be read out in bit-planes comprised of one bit per sample. During either the first frame period or the second frame period, a bit-plane of data is read from the memory, with this reading step being performed with data from the first frame and data from the second frame. The reading step is repeated such that at least the same number of bit-planes as the number of bits representing each pixel are read out during a display period. Each of the bit-planes is delivered to the spatial light modulator for display.

A technical advantage of the invention is that less memory capacity is required than for double-buffered memories. This reduces the cost of the system.

DETAILED DESCRIPTION OF THE INVENTION

A comprehensive description of a DMD-based digital television system is set out in U.S. Pat. No. 5,079,544, entitled "Standard Independent Digitized Video System", and in U.S. Pat. Ser. No. 08/147,249, entitled "Digital Television System", both assigned to Texas Instruments Incorporated, and both incorporated herein by reference.

U.S. Pat. Ser. No. 07/678,761, entitled "DMD Architecture and Timing for Use in a Pulse-Width Modulated Display System", describes a method of formatting video data for use with a DMD-based display system and a method of modulating bit-planes to provide varying pixel brightness. The general use of a DMD-based display system with a color wheel to provide sequential color images is described in U.S. Pat. Ser. No. 07/809,816, entitled "White Light Enhanced Color Field Sequential Projection". These patent applications are assigned to Texas Instruments Incorporated, and incorporated herein by reference.

Figure 1:
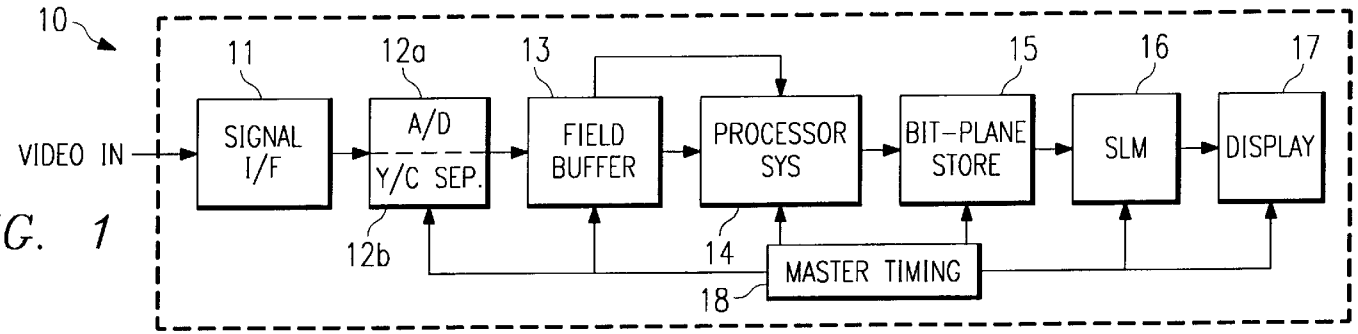
FIGS. 1 and 2 are block diagrams of a SLM-based display system, having a display memory in accordance with the invention.
Figure 2:
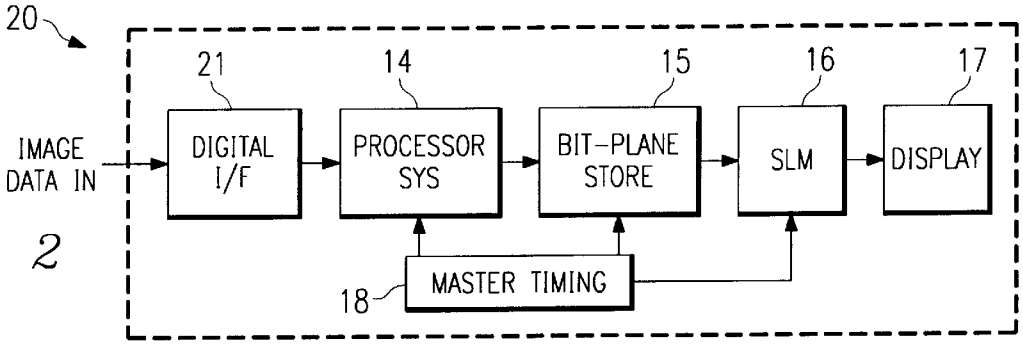

FIG. 1 is a block diagram of a SLM-based projection display system 10, which provides color images from pixel data sampled from a video signal. Although the following description is in terms of a receiver for a broadcast television signal, it should be understood that receiver 10 could be any type of equipment for receiving an analog composite video signal and displaying images represented by the signal. FIG. 2 is a block diagram of a similar system 20, in which the image data input signal already represents digital data. In both FIGS. 1 and 2, only those components significant to pixel processing and bit-plane conversion are shown. Other components, such as those used for processing synchronization and audio signals, are not shown.

The invention, which involves various aspects of memory 15, is useful with either system 10 or 20. For purposes of example, the description herein is directed to system 10.

An image having 640 pixels per row, 480 rows per frame, and 24 bits per pixel is assumed. This is after a de-interlacing process is performed by processor 14, to convert interlaced fields having 240 odd-rows or even-rows into frames having 480 rows. There are 8 bits of pixel data for each of three colors. Thus, there are 24 bit-planes. The primary effect of different frame and pixel sizes would be differences in the memory sizes described herein.

As an overview of system 10, signal interface unit 11 receives an analog television signal and separates video, synchronization, and audio signals. It delivers the video signal to AID converter 12*a* and Y/C separator 12*b*, which convert the signal into pixel-data samples and perform luminance/chrominance separation. These A/D conversion and Y/C separation tasks could be performed in either order.

A field buffer 13 is interposed between Y/C separator 12*b* and processor 14. This field buffer 13 is useful for field spreading. Because the SLM-based system 10 does not require vertical blanking time, the extra time between fields may be used to increase the time available for processing data and for loading bit-planes to the SIM 16.

Field buffer 13 may have other functions related to color wheel synchronization and scaling.

Processor system 14 prepares the data for display, by performing various processing tasks. Processor system 14 includes a processing memory for storing pixel data during processing.

Display memory 15 receives processed pixel data from processing system 14. As explained below in connection with FIGS. 3–8, display memory 15 formats incoming data into bit-planes, which it delivers to SLM 16, one at a time. Memory 15 need have only a capacity of one frame of data.

SLM 16 may be any type of SIM. Although this description is in terms of a DMD-type SIM, other types of SIMs could be substituted into system 10 and used for the method described herein. For example, SLM 16 could be an LCD-type SLM. Details of a suitable DMD can be found in U.S. Pat. No. 4,956,619, entitled "Spatial Light Modulator", which is incorporated by reference herein.

Display unit 17 is essentially the optical components for receiving the image from DMD 16 and for illuminating an image plane such as a display screen. For color displays, the bit-planes for each color could be sequenced and synchronized to a color wheel that is part of display unit 17. Or, the data for different colors could be concurrently displayed on three SLMs and combined by display unit 17. Master timing unit 18 provides various system control functions.

Figure 3:
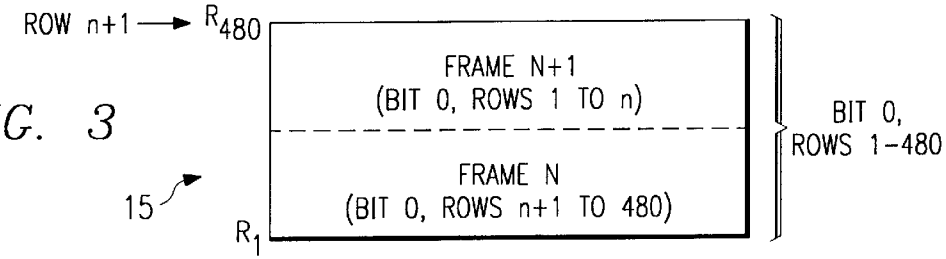
FIG. 3 illustrates a method of using a display memory in accordance with the invention.
Figure 4:
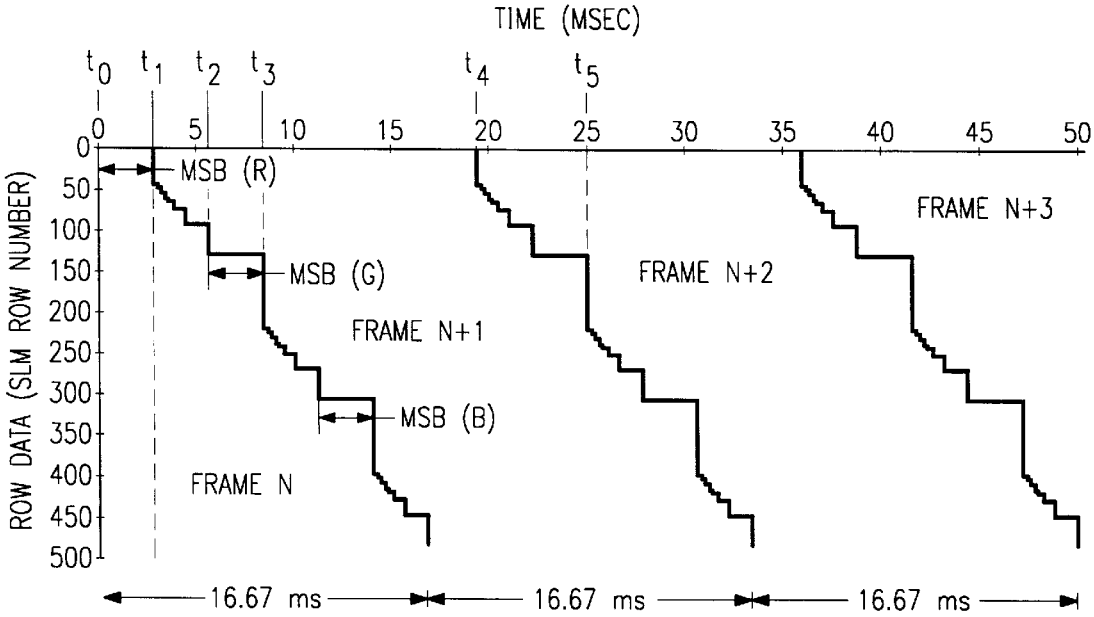
FIG. 4 illustrates how images are displayed from data of different data frames.

FIGS. 3 and 4 illustrate a method of writing into and reading out of display memory 15, in accordance with the invention. FIGS. 3 and 4 are functional illustrations; an example of a structural embodiment of memory 15 is described below in connection with FIGS. 5–8.

More specifically, FIG. 3 illustrates the spatial relationship between the writing of pixel-data samples to memory 15 and the reading of bit-plane data out of memory 15. As explained below, data is stored in memory 15 in bit-level sections, where each section stores only data for one bit-level. The section illustrated in FIG. 3 stores data for bit 0. For storing a frame of data, memory 15 has the same number of sections as bit-planes.

In the example of FIG. 3, the 480 rows of bit 0 data are stored in contiguous memory rows, $R_1$ to $R_{480}$. However, the memory rows need not be contiguous so long as some sort of random access is available.

Also, in the example of this description, the number of pixels displayed on SLM 16 is the same as the number of samples in a data frame. In other systems, each data frame stored in memory 15 may have extra samples per row of pixel elements on SIM 16, or samples for extra rows, or both. The invention is the same in both cases, in that the capacity of memory 15 need be no more than the number of samples per data frame.

Data samples are loaded to memory 15 in the temporal order in which they arrived. Using the sample for pixel 1, row 1, Frame N as a starting point, that data sample is loaded first. Each bit of pixel 1 is written to a different memory section so that the data can be accessed by bit-level. Then the data for pixel 2, row 1, Frame N, is written, followed by the data for pixel 3, row 1, etc, until all data of row 1, Frame N, are loaded. This process repeats for row 2, row 3, etc, until all data samples of Frame N are loaded.

After row 480 of frame N is written, the write process begins again with pixel 1, row 1, Frame N+1. As each new, bit of data for Frame N+1 is written, it overwrites the corresponding bit of Frame N. Because of this overwriting, in general, at any given time, memory 15 contains row 1 through row n of Frame N+1 and row n+1 through row 480 of Frame N. Of course, there may be a time between frames, when n=480 or n=0 and memory 15 stores rows 1 through 480 of only one frame.

Data is read out of memory 15 to SLM 16 in bit-planes, one bit from each pixel of all rows. The 24 bit-planes may be read out in any order, depending on the particular modulation scheme being used. For example, the order could. be first, the bit-plane for the most significant bit (MSB), then the bit-plane for the next most significant bit, etc, and last, the bit-plane for the least significant bit (LSB). For color images, which in the example of this description have 8 bits for each of three colors, 8 bit-planes for each color represent bits 0–7 of each color.

Because memory 15 stores data from two adjacent data frames, Frame N and Frame N+1, in general, a bit-plane contains data from both Frame N and from Frame N+1. In other words, each of the 24 bit-planes that comprise an image to be displayed do not always have data from the same data frame.

For real time displays, the rate at which SLM 16 displays data must keep up with the rate of incoming data. For a system 10 having a field buffer 13 and "spread" data, the time available for writing a frame into memory and reading a frame out of memory is one field period, which for NTSC signal is 1/60 second (approximately 16.67 millisecond). Likewise, the time available for reading data out of memory 15 is one field period. For deinterlaced data, the field period is the same as the frame period. If the data is not spread, the time available for writing and reading is slightly less. In any event, SIM 16 keeps up with incoming data by displaying each new image at a rate equal to the 60 field per second frequency. Although the display period for each image is the same as the field period (16.67 milliseconds), these periods do not, in general, begin or end in unison.

FIG. 4 illustrates how the data for each image is "skewed" with respect to the data frames, as a result of the reading out process described above. The jagged lines separating the data frames are referred to herein as "frame skew lines". The period of time between two frame skew lines is one frame period (approximately 16.7 milliseconds). Each row of data is displayed for a time equal to a frame period, but the display of different rows of the same data frame may begin and end at different. times. For example, for Frame N+1, the data for row 10 is displayed from $t_1$, to $t_4$, whereas the data for row 150 is displayed from $t_3$ to $t_5$.

The bit-planes read out from memory 15 are represented as vertical time slices. At any point on a frame skew line, the data above the line are from a next frame and the data below the line are from a current frame. The frame skew lines are jagged because of the different display times allocated for different bit-planes. In other words, each bit-plane is associated with one of eight different display times that vary according to bit level. The MSBs have the longest display time, the LSBs the shortest. Where there are 24 bit-planes per frame, each frame skew line has 24 "jags". Each jag represents one bit-plane, which is in turn associated with one of the eight different bit-plane display times. In FIG. 4, the display time of each bit-plane is one contiguous time slice, but other modulation schemes are possible.

For example, time t0 to t1 is allocated for the most significant bit of red data. During this time, all data being read out to SLM 16, and hence all data being displayed, is from frame N. As another example, time t2 to t3 is allocated for the most significant bit of green data. During this time, rows 1 through 130 are from Frame N+1, whereas rows 131 through 480 are from Frame N.

The above-described method of using a display memory 15 can be used with various memory implementations. These include variations in whether the data is formatted by a separate formatting device, formatted on input with logic integrated with memory 15, or formatted on output with logic integrated with memory 15. Other variations involve partitioned memory space. Examples of display memories for an SIM-based display system are found in the following patent applications: U.S. Pat. Ser. No. 07/755,981, entitled "Data Formatter with Orthogonal Input/Output and Spatial Reordering"; U.S. Pat. Ser. No. 07/756,026, entitled "Partitioned Frame Memory for Spatial Light modulator"; and U.S. Pat. Ser. No. 08/160,344, entitled "Digital Memory for Display System Using Spatial Light Modulator". Each of these patent applications is assigned to Texas Instruments Incorporated, and is incorporated by reference herein.

Figure 5:
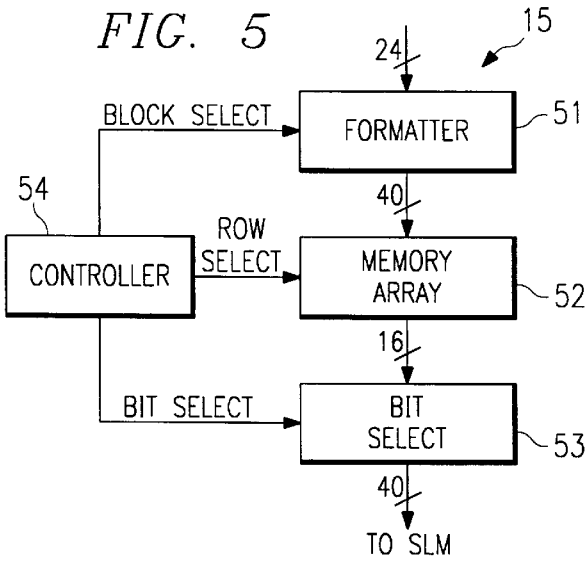
FIG. 5 illustrates a display memory.

FIG. 5 illustrates one example of a display memory 15, with which the method of the invention may be used. Memory 15 is comprised essentially of a formatter 51, a memory array 52, a bit selector 53, and a controller 54.

As described above, one aspect of the present invention is the space and time relationship of the pixel data input to memory 15 and the bit-plane data output from memory 15. The method of the present invention eliminates the requirement that the data in a display image correspond to the data in a video frame. Although the each display image contains the same amount of data as a video frame, it does not necessary comprise data from only one frame. That is, a display image may contain data from two adjacent video signal frames. Because of this relationship, memory 15 need only have a capacity of one data frame.

FIG. 5 assumes a non-partitioned memory, where memory 15 stores data for all rows. In a partitioned memory, memory 15 might store data for only the top or bottom half of SLM 16, and a second memory 15 would store data for the other half. The principles of the present invention would be the same for a partitioned memory, except that each partition would operate in parallel.

Incoming pixel data is written to memory 15 sample-by-sample, row-by-row, frame-by-frame. Thus, the incoming data is 24 bits wide. Formatter 51 re-arranges this data into bit-level data.

Figure 6:
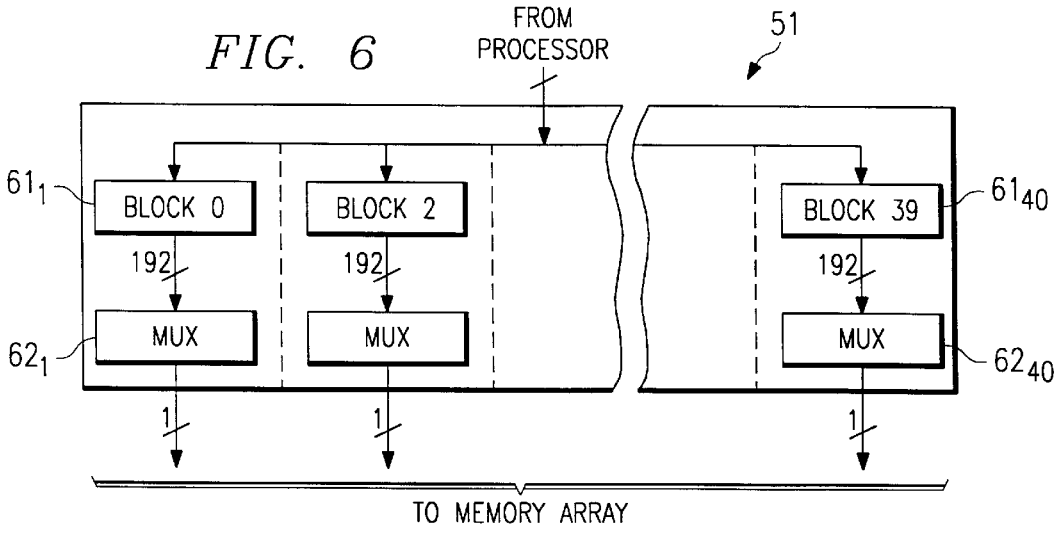
FIG. 6 illustrates the formatter of FIG. 5.

FIG. 6 illustrates one embodiment of formatter 51. Each row of data (640 pixel samples) is divided into 40 blocks of 16 samples each (40×16=640) Formatter 51 has 40 blocks, each having a block register 61. Each block register 61 receives one block of data. Because each sample is 24 bits, the capacity of each block register 61 is 384 bits (24×16=384). After the first block register 61 has been filled with data for the first sixteen samples, driver 54 addresses the next block register 61, which stores the data for the next sixteen samples. This process continues until each block register 61 has been filled with data for 16 samples, and hence the 40 block registers 61 store the data for one row.

A multiplexer 62 associated with each block register 61 receives the data from that block register 61. Each multiplexer 62 outputs its data, one bit at a time, to memory array 52.

Figure 7:
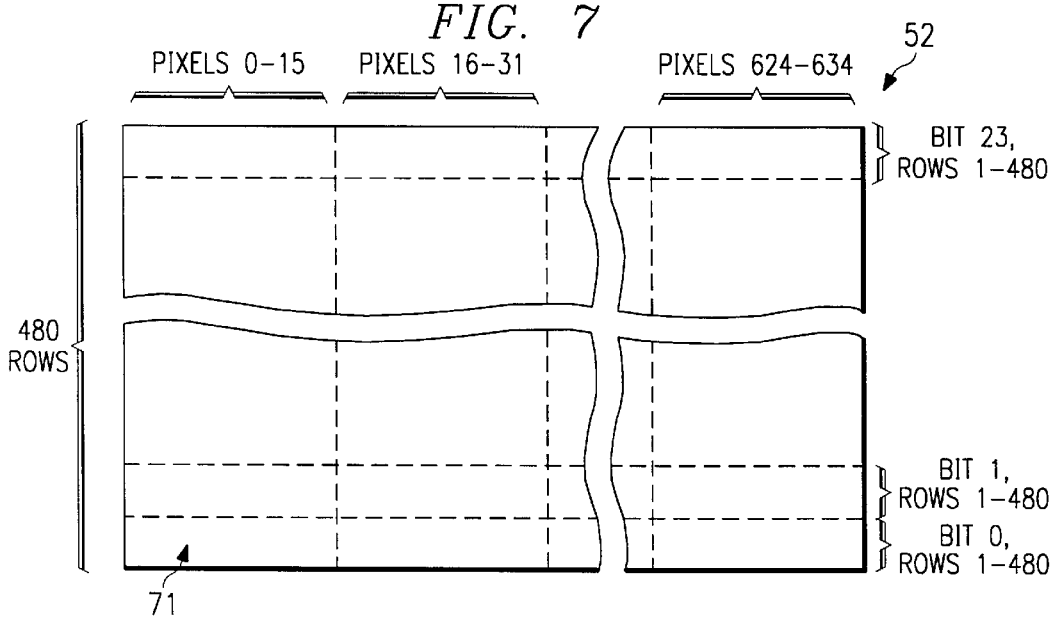
FIG. 7 illustrates the memory array of FIG. 5.

As illustrated in FIG. 7, memory array 52 has 40 columns, one column for each block register 61 of formatter 51. Each column stores data for 16 pixels of 480 rows. Each column is further divided into bit-plane areas 71, for storing bit levels of the 16 pixels and 480 rows of that column. Each area 71 stores 7680 bits (1 bit per pixel×16 pixels per row ×480 rows=7680 bits). Each column has 24 areas 71, one for each bit-level. Across the 40 columns of array 52, the 24 bit-planes that comprise one image are stored. In FIG. 3, the section of memory 15 illustrated in that figure for this embodiment of memory 15 is 40 sections 71 of array 52.

Referring again to FIG. 5, the data moves from array 52 into bit select unit 53 As compared to the data into formatter 51, the data into bit selector 53 arrives in bit-level order.

Figure 8:
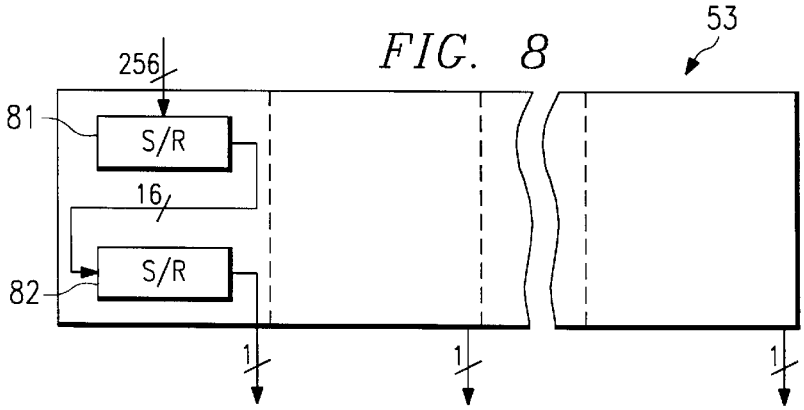
FIG. 8 illustrates the bit selector of FIG. 5.

FIG. 8 illustrates bit selector 53 in further detail. Bit selector 53 has 40 columns, one associated with each column of array 52. Each column has a first shift register 81, which receives 256 bits of data (1 bit×16 pixels×16 rows=256 bits) from a bit-plane section 71 of array 52. These 256 bits are of the same bit level but from different rows, such that across the 40 columns of bit selector 53, the shift registers 81 store one level of bit-plane data for 16 rows. A second shift register 82 inn each column selects every 16th bit so that the data delivered to SIM 16 is in bit-planes, row-by-row. Each of the 40 columns delivers 1 bit at a time to SLM 16.

Referring again to FIG. 5, controller 54 provides block addresses, row addresses, and bit-plane addresses for formatter 51, array 52, and bit selector 53, respectively. These addresses may be generated internally with counters, or provided externally by processor 14 or a timing unit. In the former case, memory 15 will be addressed in contiguous rows, whereas in the latter case, memory 15 may be addressed row-randomly. Another function of controller 54 is to resolve conflicts if access to the same data for reading and writing is attempted. This may be accomplished with techniques known in the art of memory management, especially for the case of dual ported memories.

The memory described in connection with FIGS. 5–8 is only one example of a display memory with which the invention may be used. Other types of display memories may use other means for formatting the data into bit-planes. U.S. Pat. Ser. No. 08/160,244 (referred to above), describes a display memory 15 that stores data in pixel format and has a means for re-formatting the data into bit-planes on output. Regardless of the implementation, the method of the present invention is the same in that a single-buffered memory delivers bit-planes of data that are comprised of data from two adjacent data frames.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A method of using a memory for storing data for use in a display system having a processor for processing pixel data and having a spatial light modulator (SLM) for generating an image, comprising the steps of:

writing a first video frame of samples of pixel data into said memory during a first frame period;

writing a second video frame comprised of samples of pixel data to said memory during a second frame period, such that each sample of said second video frame is written over the corresponding sample of said first video frame;

reading said data from said memory in bit-planes;

repeating said reading step such that at least the same number of bit-lanes as the number of bits representing each pixel intensity are read out during a display frame period;

wherein one or more of the reading steps are performed with data from said samples of said first video frame and data from said samples of said second video frame;

delivering each of said bit-planes to said spatial light modulator, wherein said spatial light modulator displays such bit-planes as a display frame with said data from said first video frame and data from said second video frame in each said bitlane and in each said display frame; and wherein all of said steps are repeated to generate a continuous display of images.

2. The method of claim 1, wherein said writing steps occur in contiguous rows of said memory.

3. The method of claim 1, wherein said writing steps occur in randomly accessible rows of said memory.

4. The method of claim 1, wherein said memory is partitioned into multiple areas and said writing and reading steps occurs in parallel for each partition of said memory.

5. The method of claim 1, wherein said writing step is performed with one or more input registers, to which data is written in pixel format, and with a memory array, which receives bit-level data from said one or more input registers.

6. The method of claim 1, wherein said reading step is performed with two or more output registers, which receive bit-level data from a memory array and which select said bit-level data on a row-by-row basis.

7. The method of claim 1, further comprising the step of using a memory controller to arbitrate conflicts between said writing steps and said reading step.

8. The method of claim 1, wherein one or more of the reading steps occurs during said first frame period, such that the bit-plane is comprised of data from said first data frame.

9. The method of claim 1, wherein said reading step is repeated in the same bit-level order for each bit-plane.

10. The method of claim 1, wherein said reading step is performed once for each of said bit-planes.

11. The method of claim 1, wherein said reading step is performed more than once for one or more of said bit-planes.

* * * * *